US009115563B2

(12) United States Patent
Kotrla et al.

(10) Patent No.: US 9,115,563 B2
(45) **Date of Patent: *Aug. 25, 2015**

(54) BOP STACK WITH A UNIVERSAL INTERVENTION INTERFACE

(71) Applicant: Cameron International Corporation, Houston, TX (US)

(72) Inventors: Johnnie E. Kotrla, Katy, TX (US); Ross Stevenson, Magnolia, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/266,551

(22) Filed: Apr. 30, 2014

(65) Prior Publication Data

US 2014/0231088 A1 Aug. 21, 2014

Related U.S. Application Data

(63) Continuation of application No. 12/964,418, filed on Dec. 9, 2010, now Pat. No. 8,746,345.

(51) Int. Cl.

| | |
|---|---|
| ***E21B 33/064*** | (2006.01) |
| ***E21B 33/068*** | (2006.01) |
| ***E21B 33/076*** | (2006.01) |

(52) U.S. Cl.

CPC ..... *E21B 33/076* (2013.01); *E21B 33/064* (2013.01); *E21B 33/068* (2013.01)

(58) Field of Classification Search

CPC ... E21B 33/064; E21B 33/068; E21B 33/076; E21B 34/04; E21B 34/16

USPC ..... 166/344, 347, 351, 360, 363, 368, 373; 137/315.02; 251/1.1–1.3

See application file for complete search history.

(56) References Cited

U.S. PATENT DOCUMENTS

| | | | | |
|---|---|---|---|---|
| 3,603,409 | A * | 9/1971 | Watkins | 175/7 |
| 4,046,191 | A * | 9/1977 | Neath | 166/352 |
| 4,063,602 | A * | 12/1977 | Howell et al. | 175/7 |
| 4,147,221 | A * | 4/1979 | Ilfrey et al. | 175/7 |
| 4,632,188 | A * | 12/1986 | Schuh et al. | 166/368 |
| 4,813,495 | A * | 3/1989 | Leach | 175/6 |
| 5,255,745 | A * | 10/1993 | Czyrek | 166/347 |

(Continued)

FOREIGN PATENT DOCUMENTS

WO WO 2008020232 A2 * 2/2008

OTHER PUBLICATIONS

International Search Report and Written Opinion dated Jul. 11, 2012 for PCT Application No. PCT/US2011/063780 filed Dec. 7, 2011.

*Primary Examiner* — Matthew Buck
(74) *Attorney, Agent, or Firm* — Chamberlain Hrdlicka

(57) ABSTRACT

Systems for accessing a well bore including a BOP stack with a universal intervention interface are disclosed. In some embodiments, the system includes a BOP stack and a valve assembly. The BOP stack has a throughbore and is installable on a well such that the throughbore is in fluid communication with the well bore. The valve assembly is coupled to the BOP stack and includes a fluid flowpath in fluid communication with the BOP stack throughbore, two valves connected in series and disposed along the fluid flowpath, the valves operable to control flow through the fluid flowpath, and a ROV panel including ports accessible by a ROV for operation of the two valves.

20 Claims, 10 Drawing Sheets

(56) References Cited

U.S. PATENT DOCUMENTS

| | | | | | |
|---|---|---|---|---|---|
| 5,280,766 | A * | 1/1994 | Mohn | 166/368 |
| 5,727,640 | A * | 3/1998 | Gleditsch | 175/7 |
| 5,848,656 | A * | 12/1998 | Møksvold | 175/7 |
| 5,984,012 | A * | 11/1999 | Wactor et al. | 166/364 |
| 6,076,605 | A * | 6/2000 | Lilley et al. | 166/368 |
| 6,352,114 | B1 * | 3/2002 | Toalson et al. | 166/343 |
| 6,474,422 | B2 * | 11/2002 | Schubert et al. | 175/69 |
| 6,481,504 | B1 * | 11/2002 | Gatherar | 166/344 |
| 6,494,257 | B2 * | 12/2002 | Bartlett et al. | 166/86.2 |
| 6,520,262 | B2 * | 2/2003 | Barnett et al. | 166/367 |
| 7,331,396 | B2 * | 2/2008 | Reimert et al. | 166/368 |
| 8,176,985 | B2 * | 5/2012 | Humphreys | 166/358 |
| 8,746,345 | B2 * | 6/2014 | Kotrla et al. | 166/344 |
| 2003/0145999 | A1 * | 8/2003 | Gatherar et al. | 166/368 |
| 2006/0037758 | A1 | 2/2006 | Reynolds | |
| 2009/0095464 | A1 * | 4/2009 | McGrath et al. | 166/53 |
| 2009/0101350 | A1 * | 4/2009 | O'leary et al. | 166/344 |
| 2010/0025044 | A1 * | 2/2010 | McKay et al. | 166/359 |
| 2011/0061854 | A1 * | 3/2011 | Davies | 166/95.1 |

* cited by examiner

BOP STACK WITH A UNIVERSAL INTERVENTION INTERFACE

BACKGROUND

This application is a continuation of U.S. application Ser. No. 12/964,418, filed on Dec. 9, 2010, which is incorporated herein by reference in its entirety.

BACKGROUND

The disclosure relates to a blowout preventer (BOP) stack. More particularly, the disclosure relates to a BOP stack with an interface that, when the BOP stack is installed on a wellhead, allows access to the well bore.

As is well known, a blowout preventer (BOP) stack is installed on a wellhead to seal and control an oil and gas well during drilling operations. A drill string may be suspended inside a drilling riser from a rig through the BOP stack into the well bore. A choke line and a kill line are also suspended from the rig and coupled to the BOP stack.

During drilling operations, drilling fluid, or mud, is delivered through the drill string, and returned up an annulus between the drill string and casing that lines the well bore. In the event of a rapid influx of formation fluid into the annulus, commonly known as a "kick," the BOP stack is actuated to seal the annulus. The kick may be circulated up to rig processing equipment. Alternatively, heavier drilling mud may be delivered through the drill string, forcing fluid from the annulus through the choke line or kill line to protect the well equipment disposed above the BOP stack from the high pressures associated with the formation fluid. Assuming the structural integrity of the well has not been compromised, drilling operations may resume. However, if drilling operations cannot be resumed, cement or heavier drilling mud is delivered into the well bore to kill the well.

Were the BOP stack to fail to actuate in response to a surge of formation fluid pressure in the annulus, a blow out may occur. The blow out may result in loss of life to those aboard the rig, damage to the well equipment and/or the rig, and damage to the environment. In such circumstances, apparatus and methods that enable rapid access to the well bore are desirable.

SUMMARY OF THE DISCLOSURE

Systems for accessing a well bore including a BOP stack with a universal intervention interface are disclosed. In some embodiments, the system includes a BOP stack and a valve assembly. The BOP stack has a throughbore and is installable on a well such that the throughbore is in fluid communication with the well bore. The valve assembly is coupled to the BOP stack and includes a fluid flowpath in fluid communication with the BOP stack throughbore, two valves connected in series and disposed along the fluid flowpath, the valves operable to control flow through the fluid flowpath, and a ROV panel including ports accessible by a ROV for operation of the two valves.

The system may further include a closure assembly disposed at the second end of the fluid flowpath, the closure assembly preventing fluid flow from the fluid flowpath and being removable to enable fluid flow to or from the fluid flowpath. The closure assembly may include a blind hub and a ROV operable clamp. The valve assembly may further include a tubular spool with a hub to which the closure assembly is removably coupled. The hub may have a profile that conforms to API standards. The valve assembly may be coupled to the BOP stack over a port in fluid communication with the BOP stack throughbore, the fluid flowpath of the valve assembly in fluid communication with the port. The valve assembly may be coupled to a flowline such that the flowline is in fluid communication with the BOP stack throughbore through the fluid flowpath of the valve assembly. The flowline may be one of a group consisting of a choke line and a kill line In some embodiments, the system includes a BOP stack installed on a well bore, the BOP stack having a throughbore in fluid communication with the well bore; a kill line coupled to the BOP stack in fluid communication with the well bore; a choke line coupled to the BOP stack in fluid communication with the well bore; and a valve assembly coupled to the BOP stack. The valve assembly has a first throughbore in fluid communication with the BOP stack throughbore; an actuatable valve disposed along the first throughbore, the valve operable to control fluid flow through the first throughbore; a spool having a hub; and a removable closure assembly connected to the hub, the closure assembly preventing fluid flow therethrough.

The valve assembly may be connected to the kill line and further include a second throughbore in fluid communication with the kill line and the first throughbore. The valve assembly may be connected to the choke line and further include a second throughbore in fluid communication with the choke line and the first throughbore. The valve may be a gate valve. The valve assembly may further include a ROV panel having a close port accessible to a ROV to close the valve and an open port accessible to the ROV to open the valve.

In some embodiments, the system includes a wellhead assembly having a throughbore and installable on the subsea well, wherein the wellhead assembly throughbore is in fluid communication with the well bore; a BOP stack coupled to the wellhead assembly and having a throughbore in fluid communication with the wellhead assembly throughbore; and a valve assembly coupled to the BOP stack. The valve assembly includes a fluid flowpath in fluid communication with the BOP stack throughbore; two valves connected in series and disposed along the fluid flowpath, the valves operable to control flow through the fluid flowpath; and a ROV panel including ports accessible by a ROV for operation of the two valves.

The system may further include a closure assembly disposed at the second end of the fluid flowpath, the closure assembly preventing fluid flow from the fluid flowpath and being removable to enable fluid flow to or from the fluid flowpath. The valve assembly may further include a hub to which the closure assembly is removably coupled. The hub may have a profile that conforms to API standards. The valve assembly may be coupled to the BOP stack over a port in fluid communication with the BOP stack throughbore, the fluid flowpath of the valve assembly in fluid communication with the port. The valve assembly may be coupled to a flowline such that the flowline is in fluid communication with the BOP stack throughbore through the fluid flowpath of the valve assembly. The flowline may be one of a group consisting of a choke line and a kill line.

Thus, embodiments described herein comprise a combination of features and characteristics intended to address various shortcomings associated with conventional BOP stacks and associated methods. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
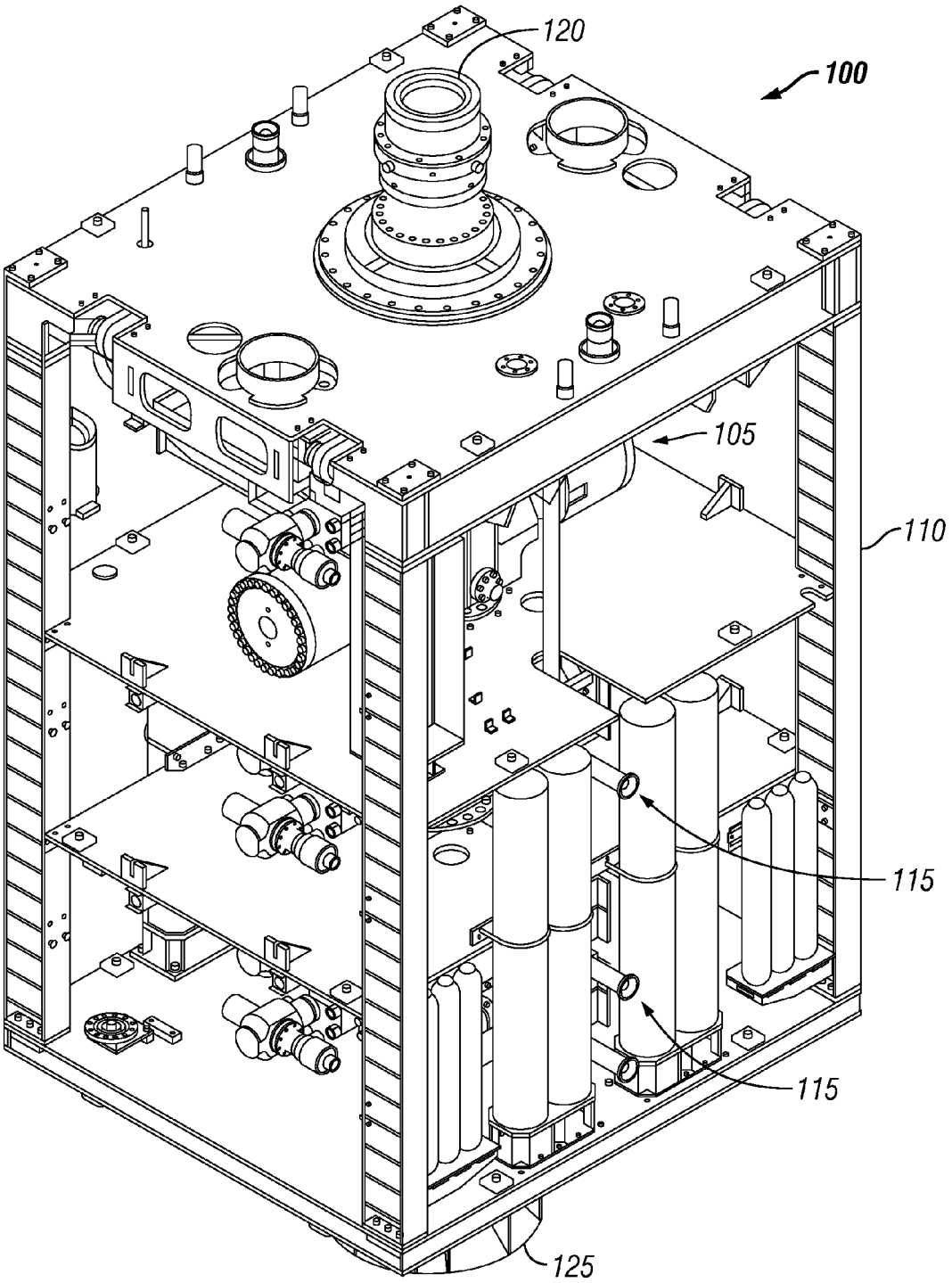
FIG. 1 is perspective view of a BOP stack assembly in accordance with the principles disclosed herein.

The following description is directed to exemplary embodiments of a BOP stack and associated methods of use. The embodiments disclosed should not be interpreted, or otherwise used, as limiting the scope of the disclosure, including the claims. One skilled in the art will understand that the following description has broad application, and that the discussion is meant only to be exemplary of the described embodiment, and not intended to suggest that the scope of the disclosure, including the claims, is limited to that embodiment.

Certain terms are used throughout the following description and the claims to refer to particular features or components. As one skilled in the art will appreciate, different people may refer to the same feature or component by different names. This document does not intend to distinguish between components or features that differ in name but not function. Moreover, the drawing figures are not necessarily to scale. Certain features and components described herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . ". Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis. The terms "radial" and "radially" generally mean perpendicular to the central or longitudinal axis, while the terms "circumferential" and "circumferentially" generally mean disposed about the circumference, and as such, perpendicular to both the central or longitudinal axis and a radial axis normal to the central or longitudinal axis. As used herein, these terms are consistent with their commonly understood meanings with regard to a cylindrical coordinate system.

Referring now to FIG. 1, there is shown a BOP stack assembly 100 in accordance with the principles disclosed herein. The BOP stack assembly 100 includes an assemblage of a plurality of individual BOPs forming a BOP stack 105 and one or more dual cavity valve assemblies 115 coupled to the BOP stack 105. The BOP stack 105 is supported on a frame 110 and has an upper end 120 and a lower end 125. The upper end 120 of the BOP stack 105 enables coupling of a lower marine riser package (not shown) thereto. The lower end 125 of the BOP stack 105 enables connection of the BOP stack 105 to a wellhead (also not shown). When the BOP stack 105 is installed on a wellhead, the dual cavity valve assemblies 115 enable connection of intervention equipment, such as but not limited to conduits, jumpers, manifolds, chokes, and injection equipment, to the BOP stack 105 and fluid communication between the well bore and the intervention equipment. As such, each of the dual cavity valve assemblies 115 is also referred to herein as an intervention assembly 115. There are two embodiments of an intervention assembly 115 shown in FIG. 1. Each embodiment is described below with reference to FIGS. 2A through 3B.

Figure 2A:
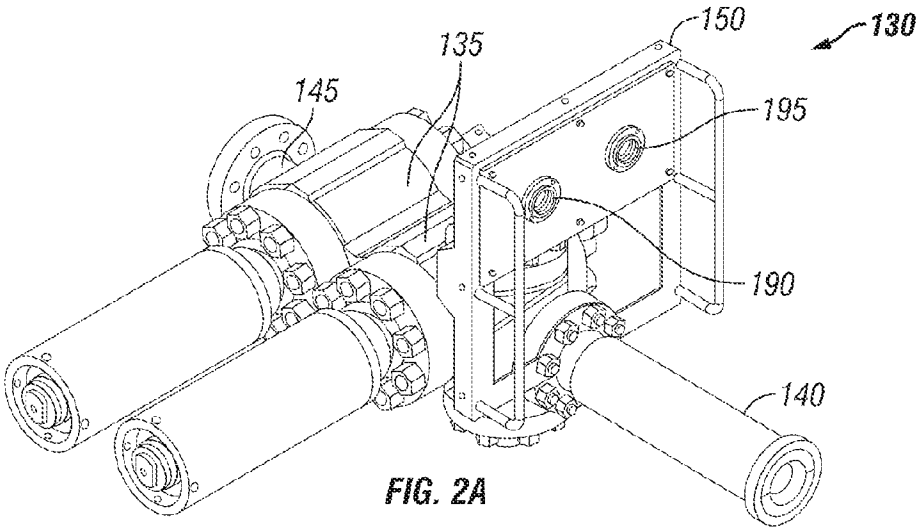
FIGS. 2A through 2C are perspective, side, and cross-sectional side views, respectively, of an embodiment of a dual cavity valve assembly shown in FIG. 1.
Figure 2C:
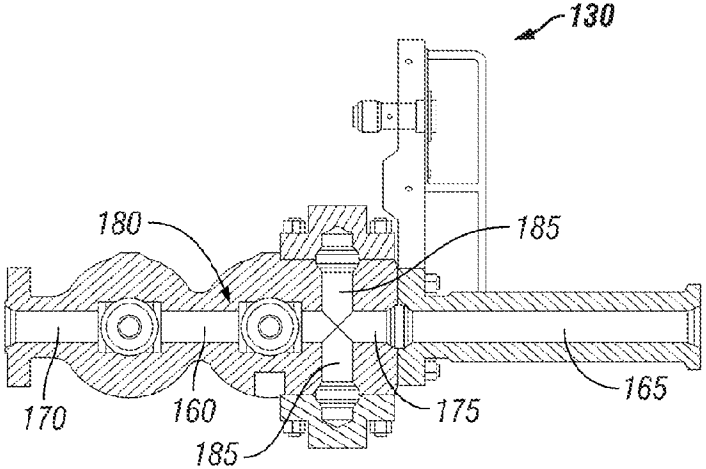
Figure 2B:
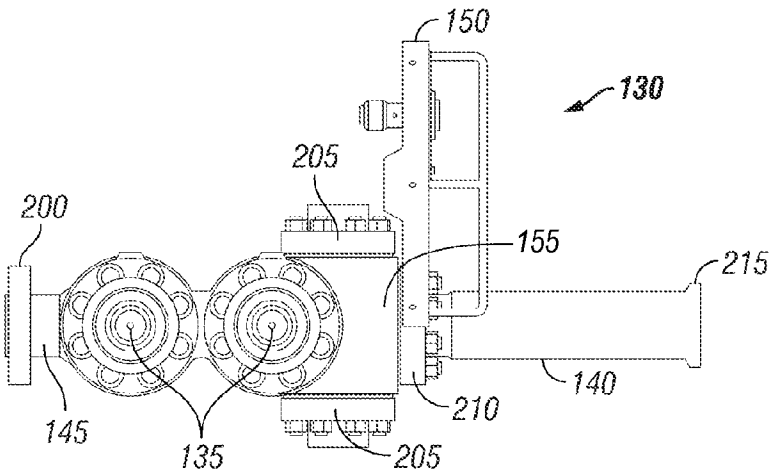

The lower intervention assembly 115 of FIG. 1 is shown in FIGS. 2A through 2C, and identified in those figures as assembly 130. As shown, the intervention assembly 130 includes two actuatable valves 135, a spool 140, a BOP connector 145, a remotely-operated vehicle (ROV) panel 150, and a housing 155. The valves 135 are connected in series for redundancy between the spool 140 and the BOP connector 145. In some embodiments, each valve 135 is a gate valve, but could be another type of valve in the industry. The housing 155 is connected to, or formed integrally with, the valve 135 proximate the spool 140.

Each of the valves 135, the spool 140, the BOP connector 145, and the housing 155 has a longitudinal flowbore 160, 165, 170, 175 respectively, best viewed in FIG. 2C. The flowbores 160, 165, 170, 175 align to form a first fluid flowpath 180 through the assembly 130. The housing 155 further includes a traverse flowbore 185 that intersects and, in this embodiment, extends substantially perpendicular to the longitudinal flowbore 175. The traverse flowbore 180 and the longitudinal flowbore 175 are in fluid communication with each other.

The ROV panel 150 that has a close port 190 and an open port 195. The ports 190, 195 are accessible to a ROV, and when accessed by the ROV, operable to close and open the valves 135 as needed. When the close port 190 is accessed, the valves 135 close, and fluid is prevented from flowing between the flowbores 170, 175 of the BOP connector 145 and the housing 155. When the open port 195 is accessed, the valves 135 open, and fluid flow is enabled through the flowbore 160 of the valves 135 between flowbores 170, 175.

The BOP connector 145 enables coupling of the assembly 130 to the BOP stack 105. The BOP connector 145 includes an end connector 200 at its end distal the valves 135. The end connector 200 may be a flange, a hub, or other type of connector, as needed, to couple with a similar connector on the BOP stack 105. In the illustrated embodiment, the end connector 200 is a flange. When the end connector 200 is connected to the BOP stack 105, fluid communication is established between the assembly 130 and the flowbore of the BOP stack 105, and thus the well bore.

The housing 155 includes two opposing connectors 205 disposed proximate the ends of the traverse flowbore 185. The connectors 205 prevent the loss of fluid from the housing 155 through the traverse flowbore 185. Also, each connector 205 is removable to enable coupling of the assembly 130 to a choke line or a kill line. When so connected, fluid communication is established between the assembly 130 and the choke or kill line, and thus the well bore. In the illustrated embodiment, the connectors 205 are blind flanges. However, in other embodiments, the connectors 205 may be hubs or other types of connectors that enable prevent the loss of fluid from the housing 155 when coupled thereto and are removable to enable coupling of the housing 155 to a choke line or a kill line.

The spool 140 has two opposing ends. At one end, the spool 140 has an end connector 210 that connects to the housing 155 and, in some embodiments, supports the ROV panel 150. The end connector 210 may be a flange, a hub, or another type of connector that enables connection of the spool 140 to the housing 155. In the illustrated embodiment, the end connector 210 is a flange. At the opposite end, the spool 140 has a hub 215. In preferred embodiments, the hub 215 has a profile that conforms to standards defined by the American Petroleum Institute (API) and enables coupling of intervention equipment thereto when needed. In such embodiments, the hub 215 provides a universal interface that enables coupling of various types of intervention equipment to the assembly 130. When the intervention equipment is not needed, the assembly 130 further includes a closure assembly 220 (FIGS. 5A, 5B) that prevents the loss of fluid from the assembly 130 through the flowbore 165 of the spool 140. In some embodiments, the closure assembly 220 includes a blind hub 222 and a clamp 225. The clamp 225 is removable by a ROV to enable coupling of intervention equipment to the hub 215 of the spool 140.

Figure 3A:
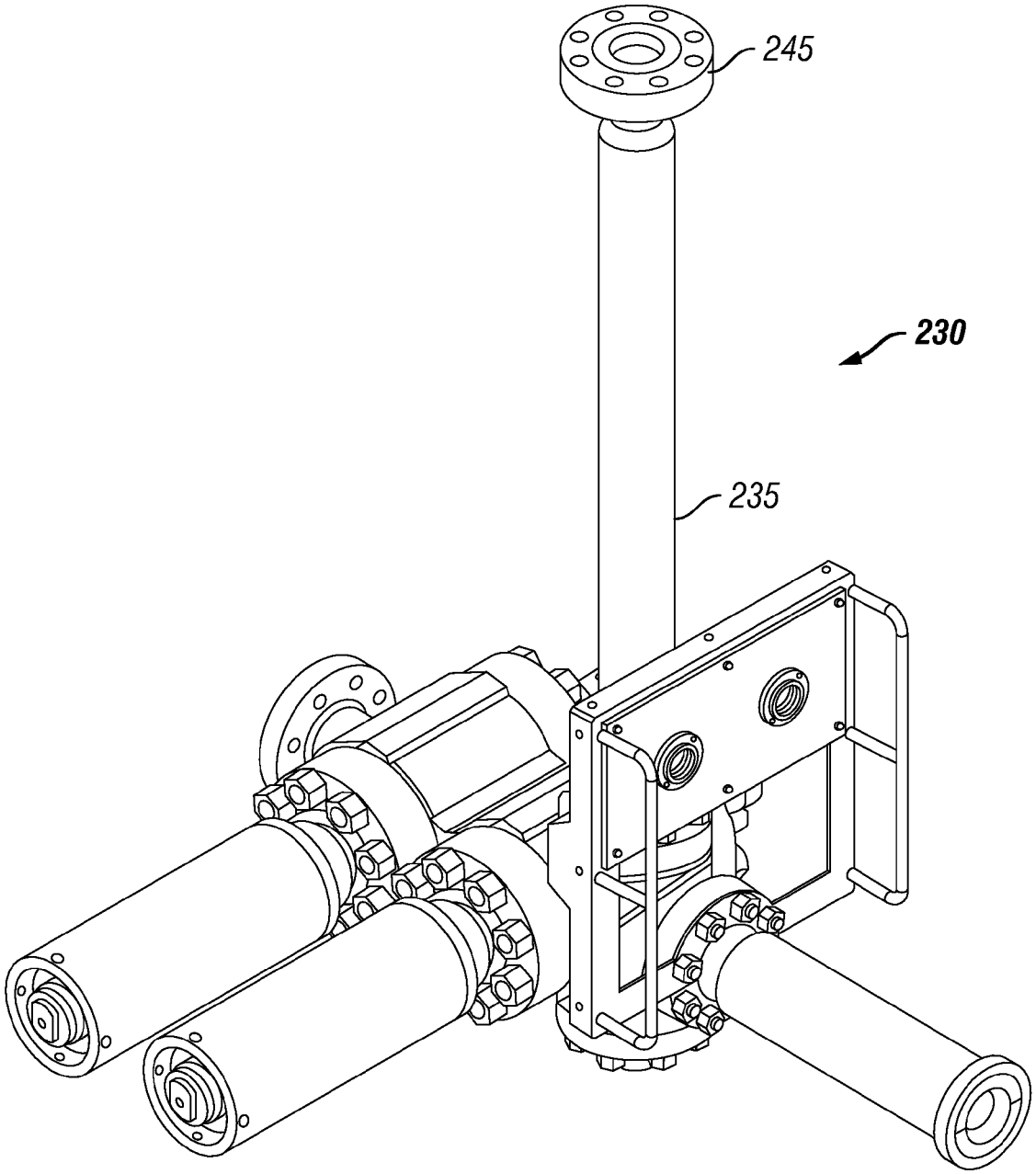
FIGS. 3A and 3B are perspective and cross-sectional side views, respectively, of another embodiment of a dual cavity valve assembly shown in FIG. 1.
Figure 3B:
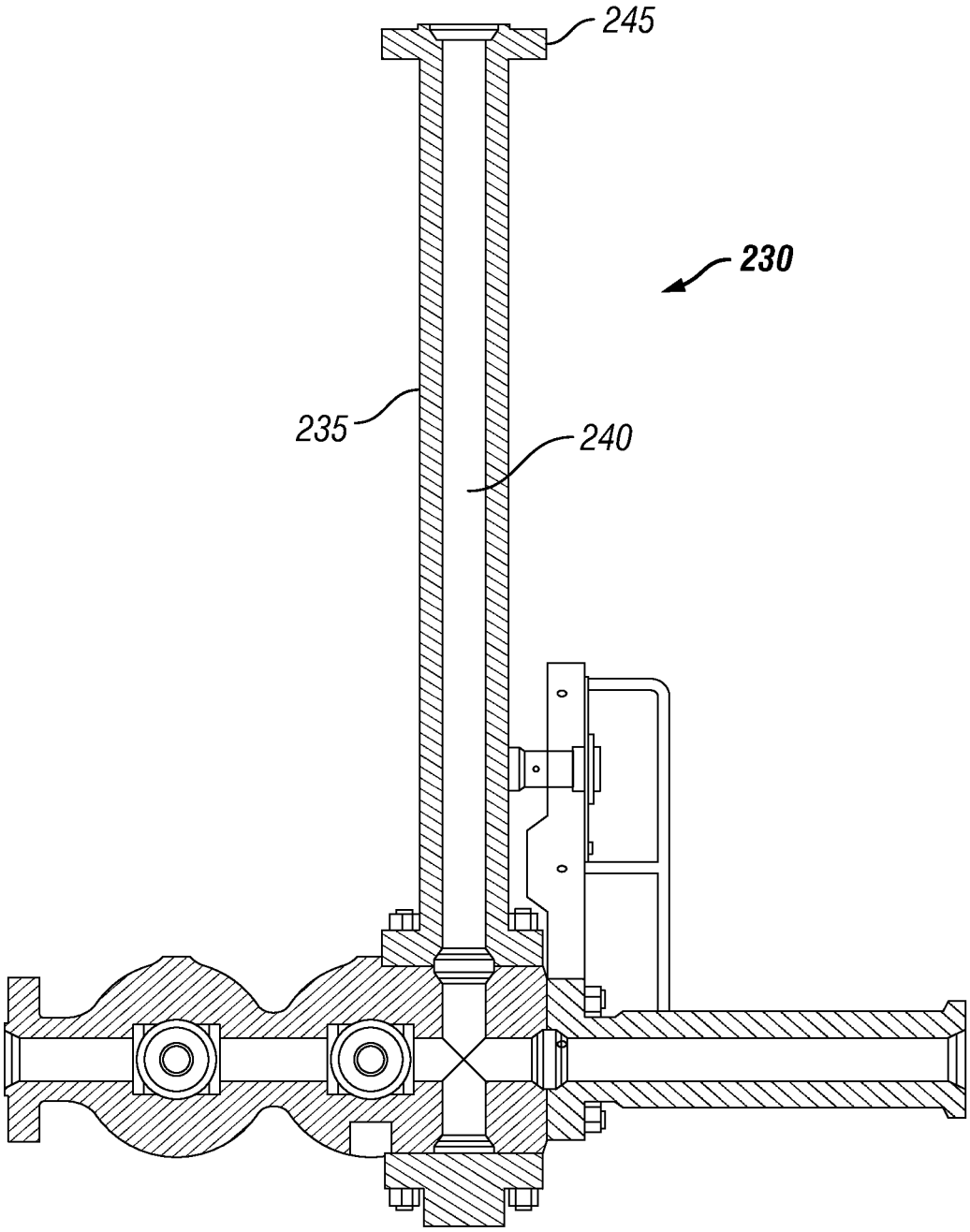

The upper intervention assembly 115 of FIG. 1 is shown in FIGS. 3A and 3B, and indentified in those figures as assembly 230. Intervention assembly 230 is substantially identical to intervention assembly 130, previously described, but for the replacement of the upper connector 205 with an extension 235. The extension 235 has two opposing ends and a flowbore 240 extending therebetween. The extension 235 is connected to the housing 155 at one end, and includes a connector 245 at the other end. The flowbore 240 is in fluid communication with the traverse flowbore 185. The connector 245 enables coupling of the assembly 230 to a choke or kill line, and may be a flange, as illustrated, a hub, or another type of connector known in the industry. When so connected, fluid communication is established between the assembly 230 and the choke or kill line.

Figure 4A:
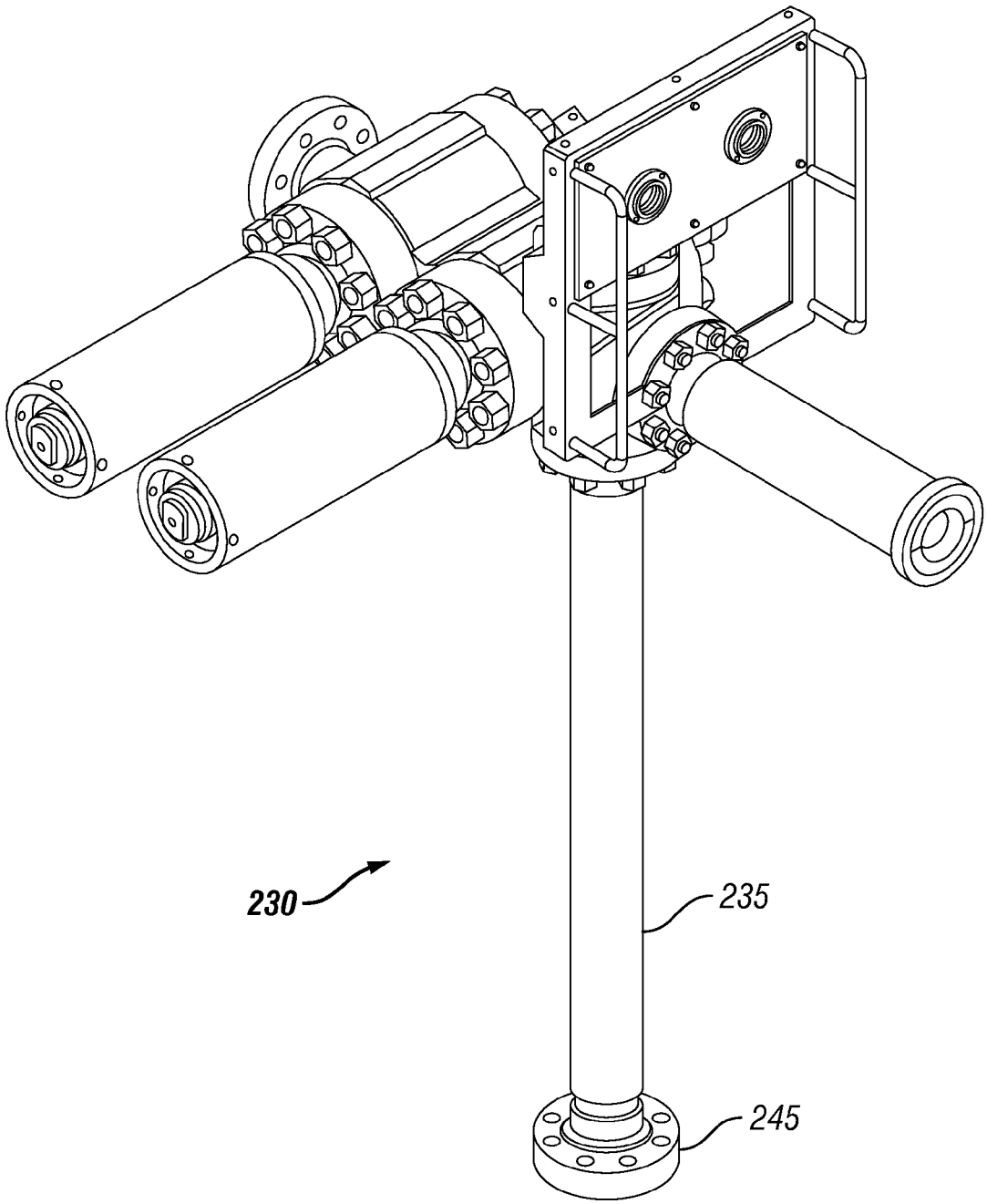
FIGS. 4A and 4B are perspective and cross-sectional side views, respectively, of yet another embodiment of a dual cavity valve assembly.
Figure 4B:
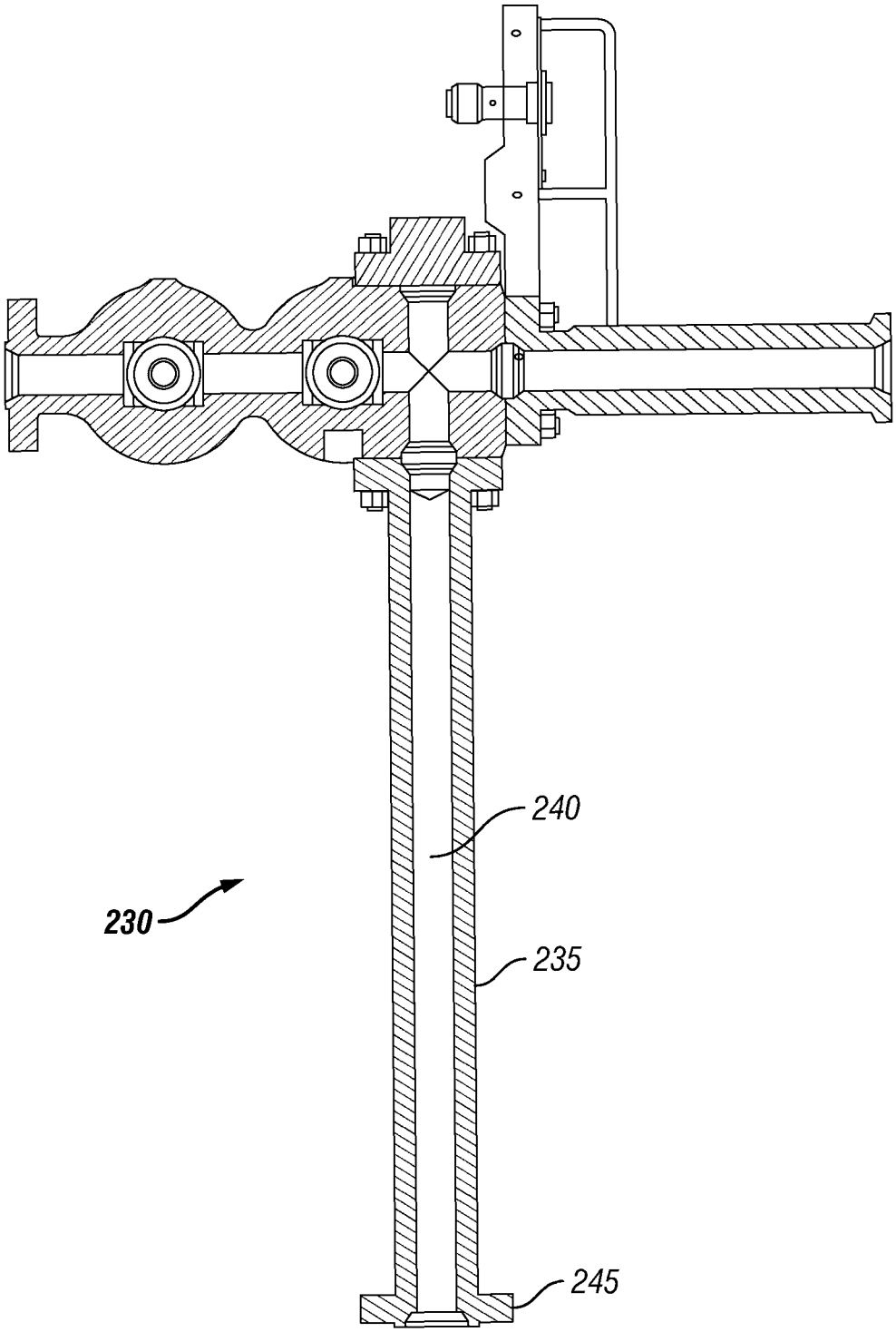

One having ordinary skill in the art will readily appreciate that the extension 235 may instead replace the lower connector 205, as illustrated by FIGS. 4A and 4B. Either way, the extension 235 enables coupling of the intervention assembly 230 to the end of a choke or kill line. Furthermore, both connectors 205 may be replaced with two extensions 235. This enables positioning of the intervention assembly 115 along a choke line or kill line, rather than at the end of one.

Figure 5A:
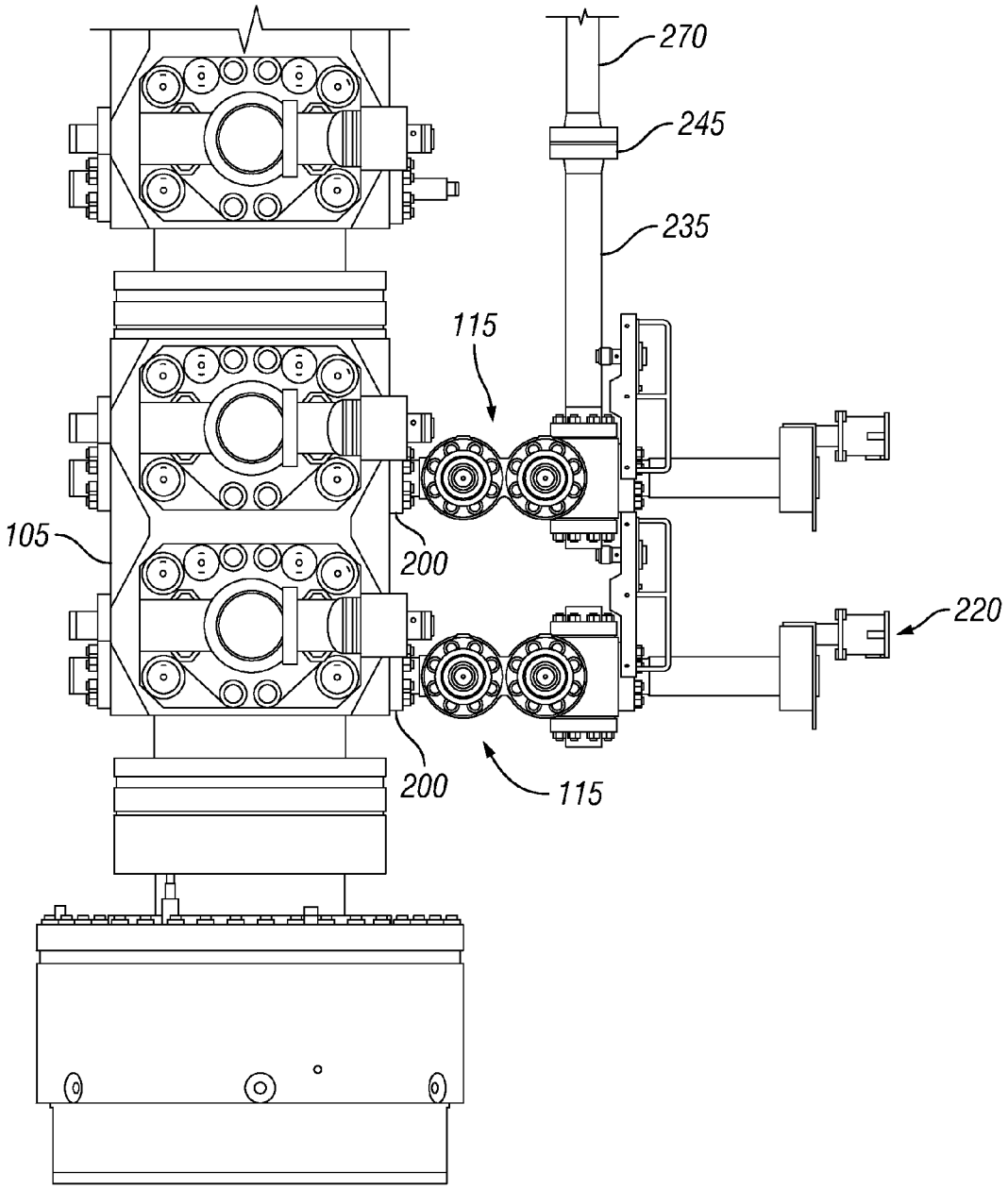
FIGS. 5A and 5B are side and cross-sectional side views, respectively, of the BOP stack of FIG. 1, illustrating the coupling of the dual cavity valves to the throughbore of the BOP stack and the choke or kill line.
Figure 5B:
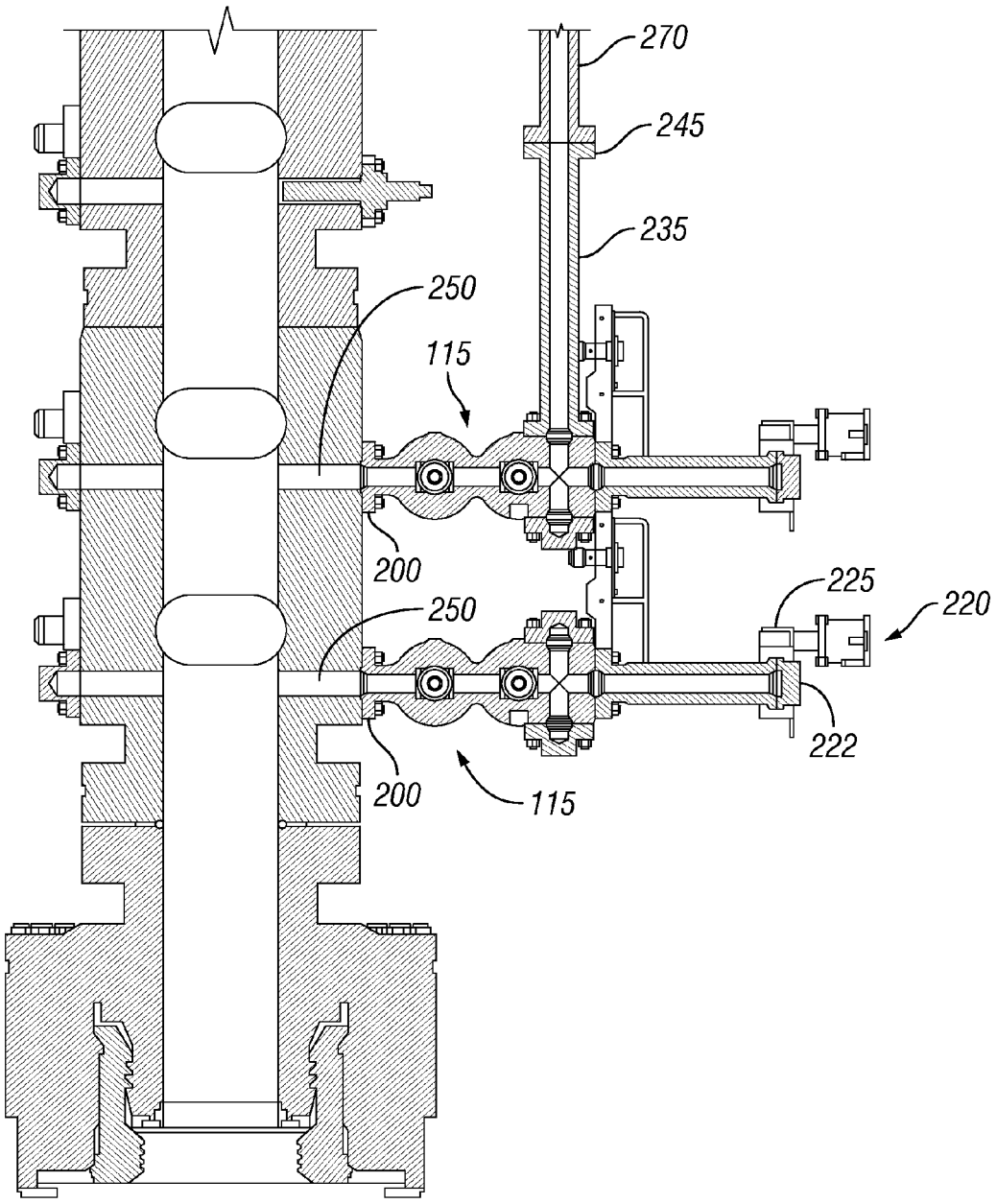
Figure 7:
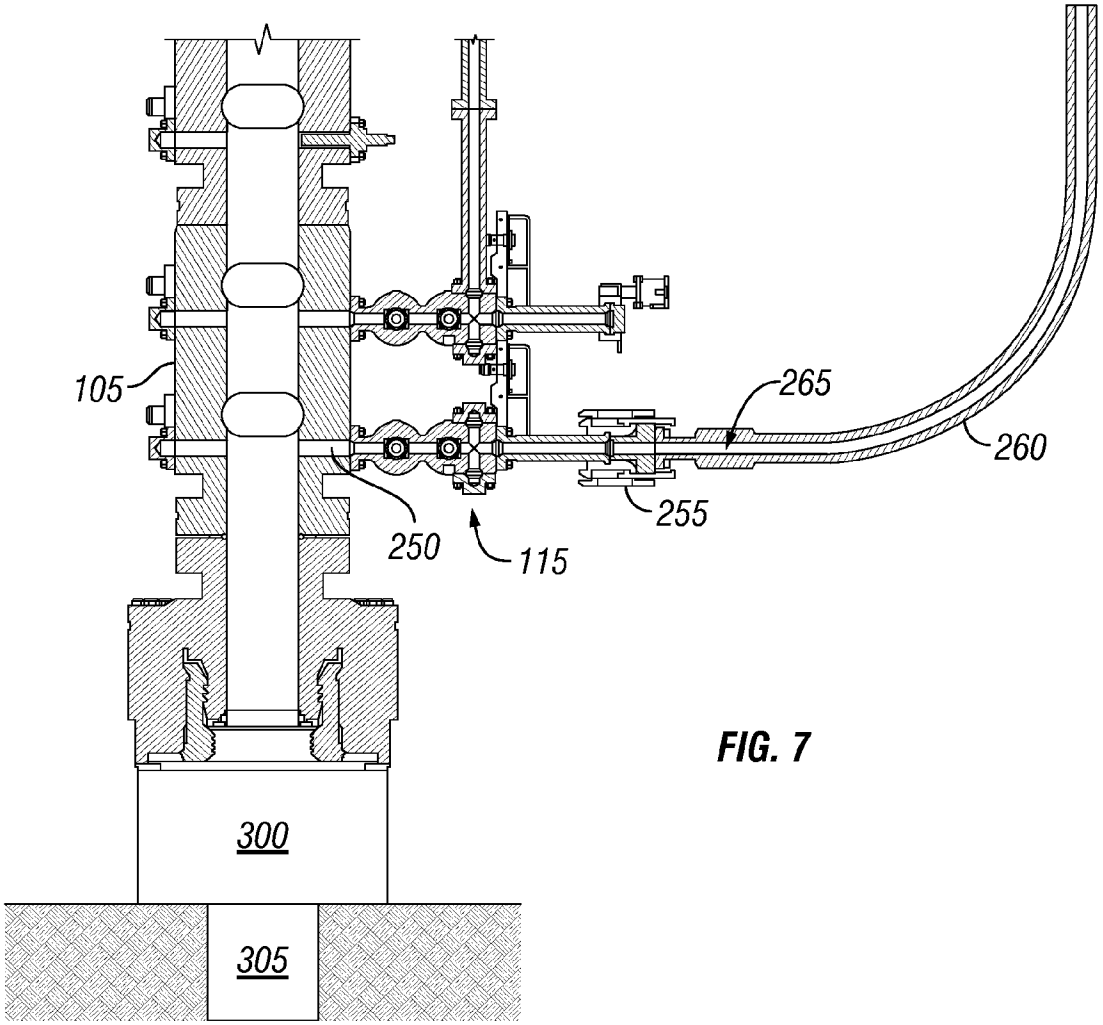
FIG. 7 is a cross-sectional side view of the BOP stack, the hydraulic connection, and the subsea flowline of FIG. 6.

Referring now to FIGS. 5A and 5B, each intervention assembly 115 is coupled to the BOP stack 105. More specifically, the flange 200 of each assembly 115 is coupled over a port 250 in the BOP stack 105 that is in fluid communication with the throughbore of the stack 105, and consequently the well bore. For embodiments of the upper intervention assembly 115 having an extension 235, such as the upper intervention assembly 115 in these figures, the extension 235 is coupled by way of its flange 245 to a choke line or a kill line 270. During use, the BOP stack 105 is installed on a wellhead 300 (FIG. 7), and provides sealing and control of the well bore 305 (FIG. 7) below. When a kick occurs, the BOP stack 105 may be actuated to close and prevent the upward flow of pressurized fluid through the flowbore of the stack 105. If the BOP stack 105 fails to fully contain the kick, a leak or blow out may occur.

Figure 6:
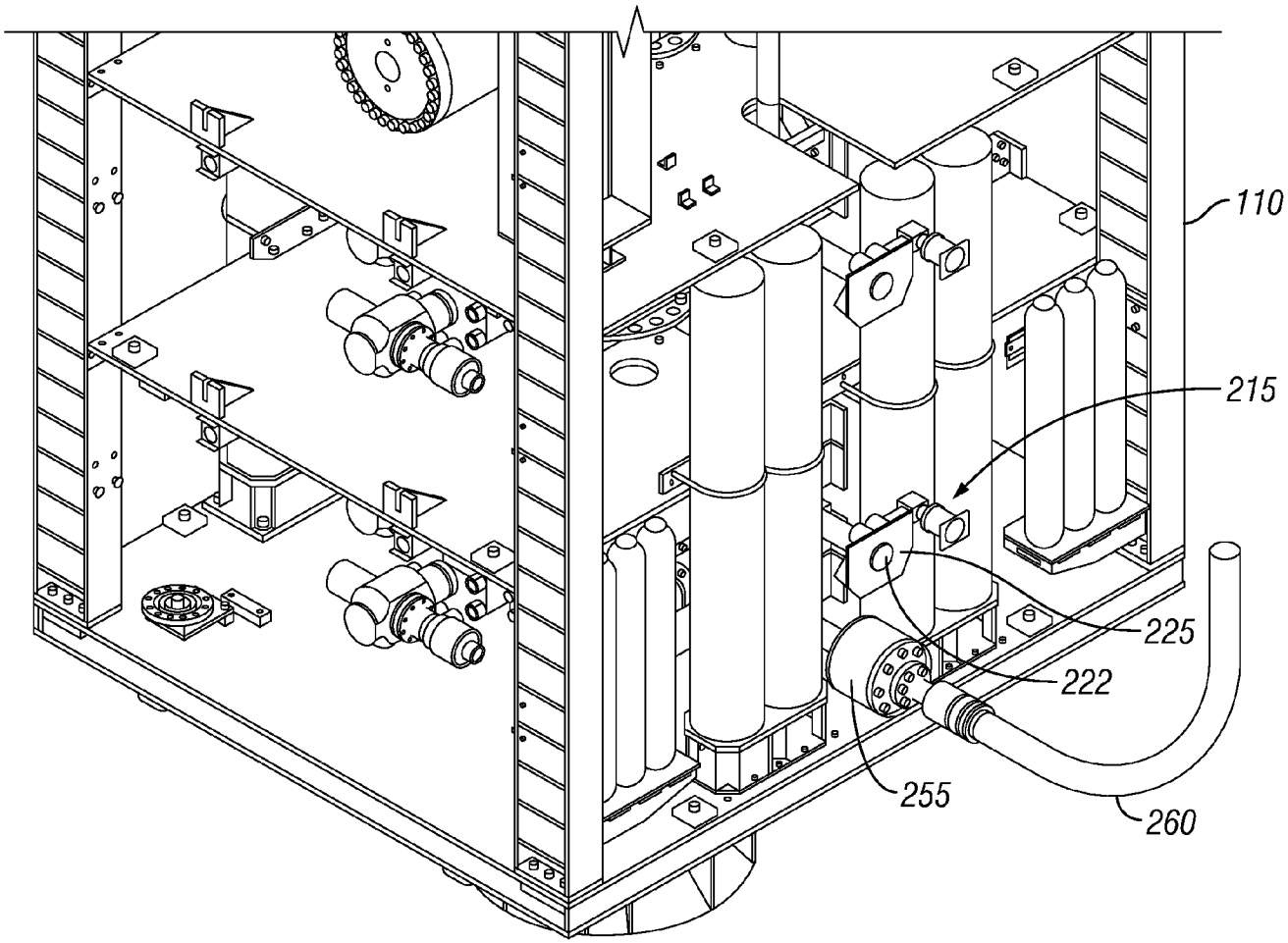
FIG. 6 is an enlarged perspective view of a hydraulic connector and a subsea flowline coupled to the BOP stack.

In the event of a leak or blowout, the system controlling the BOP stack 105 may be damaged and rendered partially or totally inoperable. In such cases, a ROV is deployed to the BOP stack 105, and maneuvered to remove the closure assembly 220 from at least one intervention assembly 115, connect intervention equipment to the now-exposed hub 215 of the assembly 115, and open the valves 135 of the assembly 115 to access the well bore. For example, as illustrated by FIG. 6, the ROV may remove the clamp 225 and blind hub 222 of the lowermost intervention assembly 115 and connect a hydraulic connector 255 and subsea flowline 260 to the hub 210 of the spool 135. The ROV may then open the valves 135 of the assembly 115 via the ROV panel 150. When the valves 135 are open, a fluid flowpath 265 is established between the subsea flowline 260 and the well bore 305, as best viewed in FIG. 7. The flowpath 265 enables injection of cement, heavy drilling mud, or any other fluid through the subsea flowline 260 and into the well bore 305 to control the well or kill the well, if so desired. Alternatively, the flowpath 265 enables diversion of high pressure formation fluid from the flowbore of the BOP stack 105 through the subsea flowline 260 to a remote location for processing, storage, or disposal, as needed.

While various embodiments have been shown and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A system for accessing a bore of a subsea well through a BOP stack using different types of intervention equipment, the system comprising:

a valve assembly configured to couple to the BOP stack, the valve assembly including:

a fluid flowpath configured to be in fluid communication with a throughbore of the BOP stack;

two valves connected in series and disposed along the fluid flowpath, the valves operable to control flow through the fluid flowpath;

a tubular spool attached to the two valves opposite the BOP stack so as to be in fluid communication with the fluid flowpath, the tubular spool comprising a hub suitable for connection by the different types of intervention equipment; and a ROV panel including ports accessible by a ROV for operation of the two valves.

2. The system of claim 1, wherein the hub comprises a universal intervention interface.

3. The system of claim 1, wherein the hub comprises a profile that conforms to API standards.

4. The system of claim 1, wherein the different types of intervention equipment comprise at least one of a flow line, a gooseneck, a conduit, a jumper, a manifold, a choke, and injection equipment.

5. The system of claim 1, further comprising the BOP stack including the throughbore and installable on the subsea well such that the throughbore is in fluid communication with the subsea well, the valve assembly coupled to the BOP stack such that the fluid flowpath is in fluid communication with the BOP stack throughbore.

6. The system of claim 5, wherein the valve assembly is coupled to the BOP stack over a port in fluid communication with the BOP stack throughbore, the fluid flowpath of the valve assembly in fluid communication with the port.

7. The system of claim 5, wherein the BOP stack is supported on a frame, and wherein the hub of the tubular spool extends from the BOP stack to be at least flush with a footprint of the frame.

8. The system of claim 1, wherein the tubular spool comprises a flowbore that extends in a direction substantially parallel to a flowbore of at least one of the two valves, wherein the ROV panel defines a plane, wherein the tubular spool comprises an elongated cylindrical profile that extends out substantially perpendicular to the plane of the ROV panel, and wherein a length of the tubular spool is at least the same size as a height of the ROV panel.

9. The system of claim 1, further comprising a closure assembly disposed at the hub, the closure assembly preventing fluid flow from the fluid flowpath and being removable to enable fluid flow to or from the fluid flowpath, and wherein the closure assembly comprises a blind hub and a ROV operable clamp.

10. The system of claim 1, wherein the valve assembly is connectable to a flowline such that the flowline is configured to be in fluid communication with the BOP stack throughbore through the fluid flowpath of the valve assembly, and wherein the flowline is one of a group consisting of a choke line and a kill line.

11. A system for accessing a bore of a subsea well through a valve assembly using different types of intervention equipment, the system comprising:

a tubular spool configured to be attached to the valve assembly opposite the subsea well so as to be in fluid communication with a fluid flowpath of the valve assembly, the tubular spool comprising a hub suitable for connection by the different types of intervention equipment; and a ROV panel connected to the tubular spool and including ports accessible by a ROV for operation of the valve assembly.

12. The system of claim 11, wherein the hub comprises a universal intervention interface.

13. The system of claim 11, wherein the hub comprises a profile that conforms to API standards.

14. The system of claim 11, wherein the ROV panel defines a plane, wherein the tubular spool comprises an elongated cylindrical profile that extends out substantially perpendicular to the plane of the ROV panel, and wherein a length of the tubular spool is at least the same size as a height of the ROV panel.

15. The system of claim 11, further comprising:

a BOP stack including a throughbore and installable on the subsea well such that the throughbore is in fluid communication with the subsea well; and the valve assembly coupled to the BOP stack such that the fluid flowpath of the valve assembly is in fluid communication with the BOP stack throughbore, the valve assembly including two valves connected in series and disposed along the fluid flowpath, the valves operable to control flow through the fluid flowpath.

16. A system for accessing a bore of a subsea well through a valve assembly using different types of intervention equipment, the system comprising:

a tubular spool configured to be attached to the valve assembly opposite the subsea well so as to be in fluid communication with a fluid flowpath of the valve assembly, the tubular spool comprising a profile that conforms to API standards suitable for connection by the different types of intervention equipment; and a ROV panel connected to the tubular spool and including ports accessible by a ROV for operation of the valve assembly.

17. The system of claim 16, wherein the tubular spool comprises a universal intervention interface that comprises a hub.

18. The system of claim 17, wherein the hub is suitable for connection by the different types of intervention equipment.

19. The system of claim 16, wherein the ROV panel defines a plane, wherein the tubular spool comprises an elongated cylindrical profile that extends out substantially perpendicular to the plane of the ROV panel, and wherein a length of the tubular spool is at least the same size as a height of the ROV panel.

20. The system of claim 16, further comprising:

a BOP stack including a throughbore and installable on the subsea well such that the throughbore is in fluid communication with the subsea well; and the valve assembly coupled to the BOP stack such that the fluid flowpath of the valve assembly is in fluid communication with the BOP stack throughbore, the valve assembly including:

two valves connected in series and disposed along the fluid flowpath, the valves operable to control flow through the fluid flowpath.

* * * * *